US006033718A

United States Patent [19]

Marias Albrich et al.

[11] Patent Number: 6,033,718

[45] Date of Patent: Mar. 7, 2000

[54] APPARATUS AND PROCESS FOR APPLYING A PROTECTIVE COATING TO A LENS DISC

[75] Inventors: Lluis Miquel Marias Albrich; Benigno Moreno Vidales; Joan Perez Agudo; Alfred Santiago Palmero, all of Barcelona, Spain

[73] Assignee: Indo Internacional, S.A., Barcelona, Spain

[21] Appl. No.: 09/081,079

[22] Filed: May 19, 1998

[30] Foreign Application Priority Data

Jun. 3, 1997 [ES] Spain ..... 9701207

[51] Int. Cl.[7] ..... B05D 5/06; B05C 11/00

[52] U.S. Cl. ..... 427/2.1; 427/8; 427/10; 427/164; 427/385.5; 427/554; 427/558; 427/421; 427/154; 118/668; 118/669; 118/676; 118/679; 118/305; 118/326

[58] Field of Search ..... 427/164, 8, 2.1, 427/10, 154, 421, 385.5, 377, 554, 558, 560; 118/668, 669, 676, 679, 305, 326

[56] References Cited

U.S. PATENT DOCUMENTS 5,114,740 5/1992 Plate et al. ..... 427/164

*Primary Examiner*—Janyce Bell
*Attorney, Agent, or Firm*—Sughrue, Mion, Zinn Macpeak & Seas, PLLC

[57] ABSTRACT

An apparatus and procedure for applying a protective coating to a lens disc; the procedure comprises the positioning of trays (7) carrying lens discs, on a conveyor belt (9), which comes to a halt opposite a sensor means which detects the lenses; the tray (7) enters a coating chamber (4) provided with a coating diffusor (11); and the tray (7) comes to a halt repeatedly leaving one of the lens carried on the tray (7) opposite the diffusor (11); the pulverised coating material is sprayed onto the lens and then the tray (7) passes on to a drying section (3). The apparatus comprises trays (7) carrying lenses; a means for the transport thereof; a chamber (4), provided with a coating diffusor (11) and a gas extraction means (13); there is also a sensor means (15) and a stopping means for regulating the movement of the tray (7) as far as the drying section (3).

18 Claims, 2 Drawing Sheets

APPARATUS AND PROCESS FOR APPLYING A PROTECTIVE COATING TO A LENS DISC

DESCRIPTION

1. Field of the Invention

The invention refers to an apparatus and process for applying a protective coating to a lens disc; said coating being applied to one surface of said lens disc intended for attachment to a blocking adaptor. The process comprises the use of at least one tray suitable for carrying at least one lens disc.

The invention also refers to an apparatus to which reference will be made hereinafter.

2. Prior Art Reference

As is already known, the equipment for cutting the surfaces of ophtalmic lenses carry out machining operations on said lenses in order to give the appropriate relation of curves between both surfaces, which in the end determine the refractive power of said opthalmic lenses. These machining operations require that a blocking adaptor be attached beforehand to one of the surfaces of the lens, usually by means of low melting point metal alloys or thermoplastics.

Using the generally known processes described above can damage the blocked surface of the lens, therefore, as an initial step, even before the lens surface is blocked, it must be protected. For this purpose, various commonly used methods exist, such as: superimposing a self-adhesive fine film, applying impact glue or tar and using spray cans which diffuse a layer or film that can later be peeled off. Each system has its own drawbacks, but, generally, they are all difficult to automate, as far as both the application step and the subsequent unblocking is concerned. In particular, the self-adhesive film is relatively expenisve compared with the other systems, while to give acceptable results i.e.: a uniform layer, spray cans must be handled with skill.

SUMMARY OF THE INVENTION

It is an object of the invention to overcome these drawbacks. This object is achieved, according to the invention by applying a process comprising the steps of: [a] positioning said tray carrying at least one lens disc, on a conveyor belt; [b] bringing said tray to a halt for a first time opposite a first sensor means for detecting the presence of a lens, said first sensor means being appropriate for detecting the number of lens discs carried on said tray; [c] introducing said tray carrying at least one lens disc, into a coating chamber provided with a coating material diffusor system; [d] bringing said tray to a halt for at least a second time, and each time leaving one of said lens discs carried on said tray opposite said diffusor system ; [e] spraying said coating material over the lens disc opposite said diffusor system; [f] introducing said tray carrying at least one lens disc into a drying section that has a ventilation system; and [g] subjecting said tray to said ventilation system. The object is also achieved using an apparatus comprising: [i] trays for carrying at least one of said lens discs; [ii] means for horizontally transporting said trays ; [iii] at least one coating chamber, provided with a coating material diffusor system and a gas extraction means; [iv] a first sensor means for detecting the presence of lens discs on said tray; [v] at least one sensor means for detecting the presence of a tray in said coating chamber; [vi] at least a second stopping means for bringing to a halt the trays detected inside said coating chamber; and [vii] a drying section suitable for receiving the lens discs from the said coating chamber; said drying section having a forced ventilation system.

Using the cited process and apparatus, prevents the surface of the lens disc from being damaged in the blocking and cutting operations characteristic of the creation of curves, which necessarily provides said lens disc with the desired refractive power.

As indicated hereinafter, the protection of the surface of the opthalmic lens face to be blocked is achieved by automatically applying a protective, water soluble and adhesive lacquer to said surface.

The advantages arising from the apparatus and procedure are:

Complete Automation of the Process

The use of an inexpensive, protective substance which is easy to apply and remove.

The uniform and controlled application of the surface layer of said lacquer, guaranteeing the correct performance of said lacquer.

The possibility of carrying out complementary operations arising from the automation itself, such as lens marking.

BRIEF DESCRIPTION OF THE DRAWING

Other advantages and features of the invention are disclosed in the following description of a preferred embodiment of the invention, with reference to the accompanying drawing, in which.

DETAILED DESCRIPTION OF THE INVENTION

Figure 1:
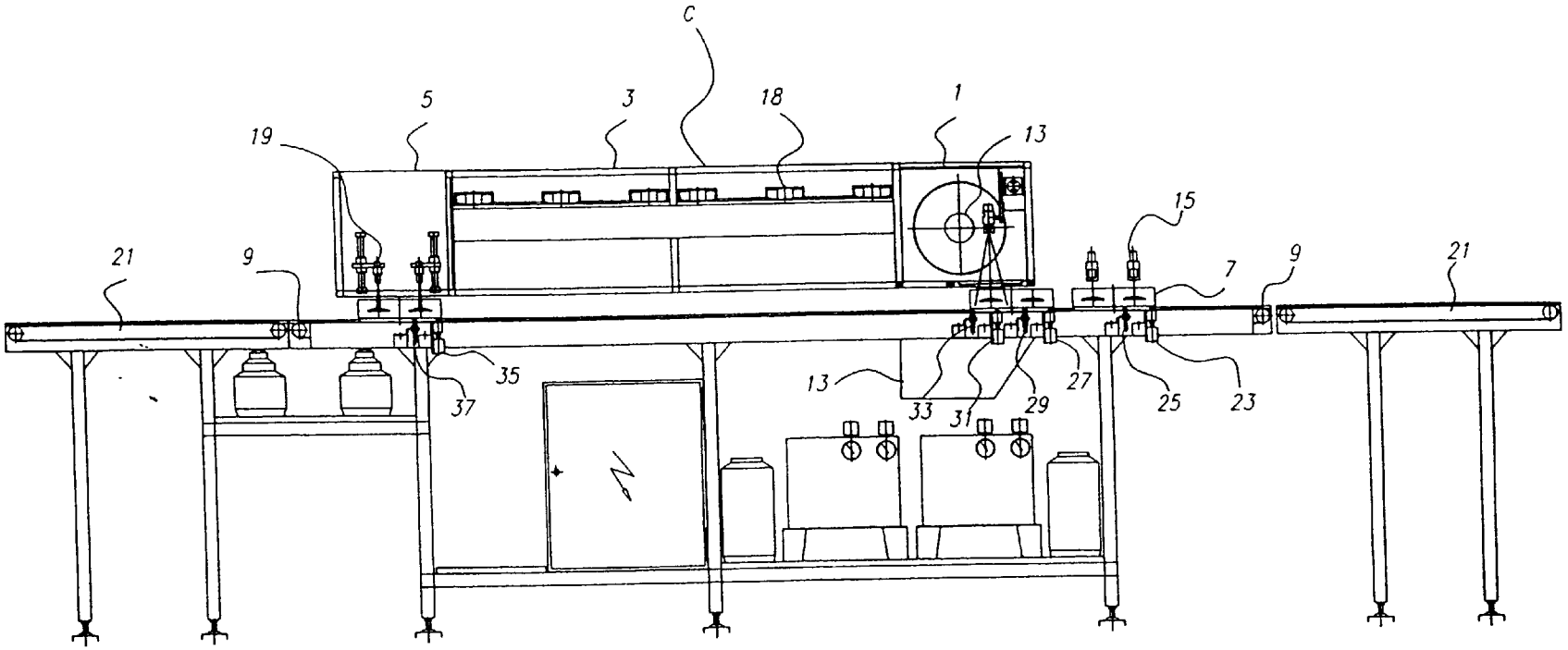
FIG. 1 is a schematic elevation view of the apparatus according to the invention.

The apparatus comprises a cabin C, which is arranged into a lacquering section 1, a drying section 3 and a third section 5 for complementary operations; in addition, it has a conveyor belt (to which further reference is made hereinafter) to move the lens discs through the three sections. These movements of the lens discs are achieved by said lenses being supported on trays 7 of the type normally used in optical laboratories; the trays 7 have a large enough surface to carry at least two separate lens discs and said trays are placed on the conveyor belt 9, which moves them through cabin C. It must be mentioned that it is preferable to organise the work so that each tray 7 contains the two lens discs corresponding to one and the same spectacle frame. However, quite frequently there are also cases where one single lens disc is required.

As already mentioned, the trays 7 are transported by means of a conveyor belt 9; preferably this belt 9 comprises two half belts or parallel belts, which are separated from each other by a distance less than the width of the trays 7, so that one end portion of the bottom of each tray rests on a respective half belt, leaving a central zone free (in between both half belts or belts) to allow the stopping members and sensors to be positioned.

In a preferred embodiment, the trays 7 have room for a maximum of two lenses, which are placed one after the other according to the direction of the movement of the conveyor belt 9.

Figure 2:
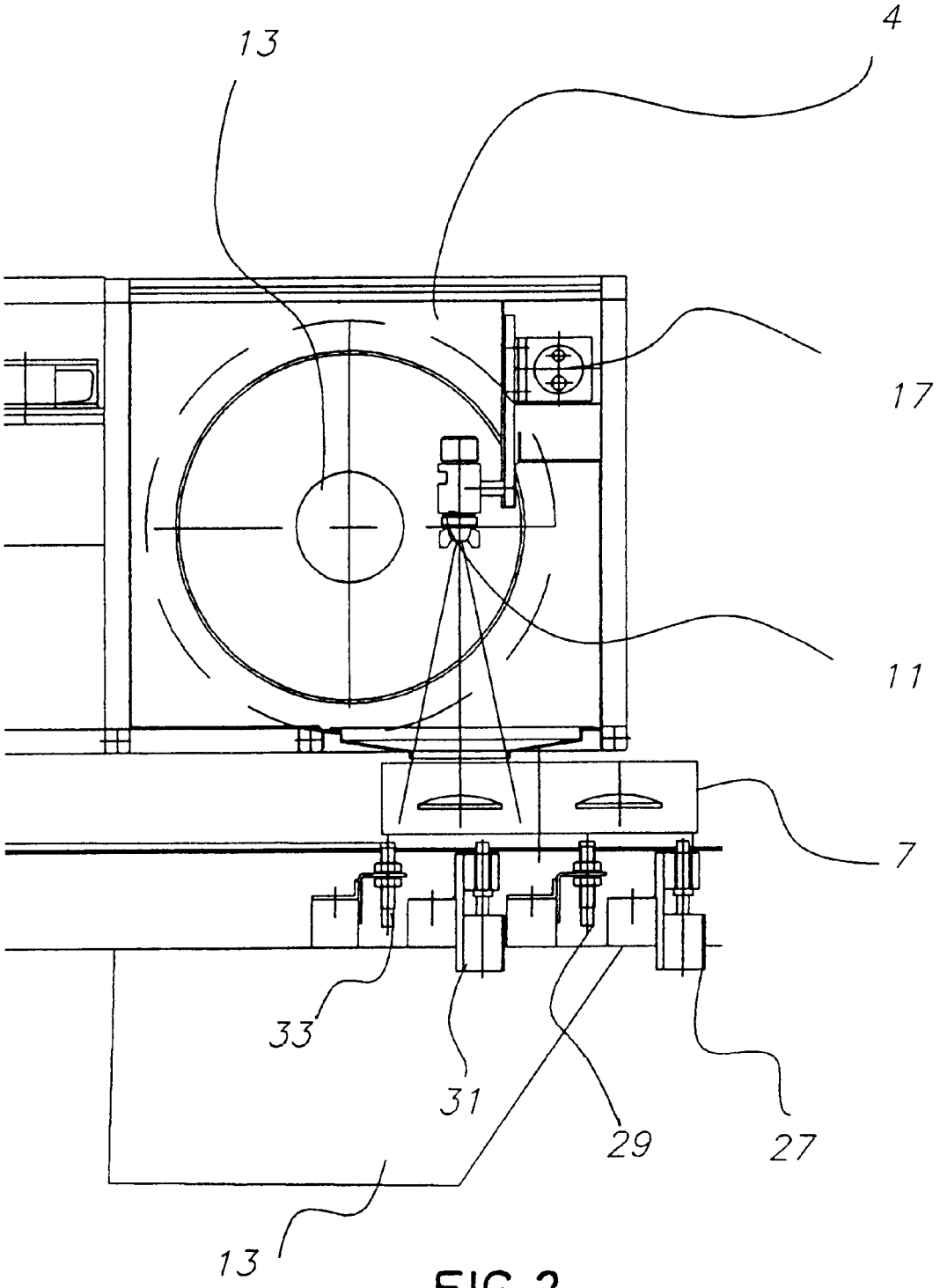
FIG. 2 is a schematic view on a larger scale of the lacquering section.

The lacquering section 1 includes a lacquering chamber 4 (FIG. 2) with one or more aerosol lacquer diffusor systems 11, preferably air brushes, provided with means to supply air pressure, as well as control it and to meter the quantity and duration of the spraying process.

It also has a gas extraction means 13 with its relevant filters. This means 13 is intended to direct the lacquer spray, so that it concentrates over the surface of the lens, and eliminate the lacquer remains in suspension; for this purpose said means has a lower extractor section which induces a sucking action that directs the flow of the lacquer spray from the diffusor system 11 towards the lower extraction section itself; the tray 7, carrying the lens discs is in the path between this diffusor system 11 and the lower extractor. As a result the lacquer cloud is less dispersed and the lens discs is coated more efficiently.

A first sensor means 15 for detecting the presence of the lens, prevents the lacquer from being sprayed onto a tray 7 without any lens discs. This first sensor means 15 is preferably of the ultrasonic or laser type.

A second tray 7 sensor means 25 and a first tray stopping means 23, are arranged in such a way as to cause the trays to stop opposite the first sensor means 15 and the lacquer diffusor system 11. In a preferred embodiment, this second tray sensor 25 means is the inductive sensor type, i.e.: based on the current and potential variations produced in a coil, i.e.: inductance, as its magnetic field is disturbed owing to the proximity of the metallic object. This second sensor means 25 is suitable for identifying a metallic marking previously inserted into the trays 7. The stopping means holds the tray 7 but the conveyor belts continue to move. Therefore, there is a sliding movement between the tray 7 and the half belts 9 until the stopping means is released, when the tray 7 is then dragged along again by the half belts 9, by the simple effect of friction between the tray and the belt.

In the event of there being provided more than one diffusor 11, there is a means 17 for moving them, thus enabling different lacquers be used, depending on the technical requirements of each lens disc.

The drying section 3 is provided with a forced ventilation system 18, which directs a current of air over the trays 7, so as to dry the lacquer deposited on the surface of the lens discs. This system 18 can be reinforced using complementary heating elements.

The section 5 of complementary operations has means 19 for marking the lens discs, depending on its type, material and order features; such means, for example, can be the air brush type that marks with washable paint. As it is normal practice to work on lens discs by arranging them into pairs i.e.: the right and left eye from the same spectacle frame, in this section 5 the right and left lens discs can be marked with different colored paint, thus facilitating the subsequent processing and reducing the possibility of errors therein.

In both ends of the cabin C in-feed and discharge belts 21 can be positioned; the former are for taking the trays 7 inside cabin C and the latter for removing the trays from cabin C once all the operations have been completed.

It has already been mentioned that in a preferred embodiment, the trays 7 have room for a maximum of two lens discs, and can carry one or two.

In a preferred embodiment, the process for applying the lacquer is as follows:

The tray 7 is introduced into cabin C either manually or by means of the in-feed belt 21, so that it rests on the conveyor belts or half-belts 9.

The tray 7 is brought to a halt opposite the first sensor means 15 for detecting the presence of the lens, by a first stopping means 23. At this point, this first sensor means 15 detects the presence of one or two lens discs on the tray 7.

The first stopping means 23 is released and the tray 7 is introduced into the lacquering chamber 4. A second stopping means 27 connected to a second presence sensor means 29, is activated to halt the tray 7 again so that the first lens disc is opposite the lacquer diffusor system 11. This only happens if lens discs have been detected at the lens disc detection step.

The lacquer diffusor system starts to spray the lens disc. In order that the spray leaves a uniform layer of lacquer on said lens, it is preferable that the second stopping means 27 is released and the spraying is carried out with the tray 7, and therefore the lens disc as well, in motion.

A third stopping means 31, associated with a presence sensor means 33, is activated so as to halt the tray 7 again so that the second lens disc is opposite the lacquer diffusor system 11. As in the previous case, this only happens if during the lens disc detection step the presence of said disc has been identified.

The lacquer spraying process is repeated for the second lens disc. Once completed, the tray 7 is conveyed to the drying section 3. The forced ventilation system 18 blows a current of air over the tray 7 and over the lens discs it is carrying, which were previously sprayed with lacquer. Preferably, the drying operation is carried out with the tray 7 in motion and the drying time is controlled by adjusting the forward speed of the conveyor belts or half belts 9. Another possible alternative is that of an additional sensor and stopping system, which keeps the tray 7 opposite the forced ventilation system 18 throughout a pre-established time period.

When the conveyor belts 9 advance the tray 7 is carried to the section 5 of complementary operations. A fourth stopping means 35 associated with a fourth presence sensor means 37, is activated to halt the tray 7 again so that each lens disc is opposite an air brush that supplies the washable paint for marking the lenses.

Each air brush sprays a small quantity of washable paint, in a different color, over the lens disc opposite it. In this way it is possible easily to distinguish the right hand lens from the left in a spectacle frame order, with the previously mentioned advantages.

Finally, the fourth stopping means 35 is released and the tray is moved as far as the discharge belt 21, where the process finishes.

Given the diversity of materials used in opthalmic lenses, it is possible to optimise the result of the lacquer application by using different formulations, depending on the material.

The invention also contemplates the possibility that the lacquer diffusor system be provided with two or more air brushes, with their means to supply and control the air pressure; in this case, each air brush sprays a specific lacquer.

In addition, means can be added to detect the material from which the lens disc is made, and this means is preferably based on the trays bearing differentiated markings and a detector being included for the marking at the entrance to the drying section 3.

What we claim is:

1. A process for applying a protective coating to a lens disc, said coating being applied to one face of said lens disc intended for attaching to a blocking adaptor, said process comprising the use of at least one tray (7) appropriate for carrying at least one lens disc, said process comprising the steps of: positioning said tray (7) carrying at least one lens disc, on a conveyor belt (9); bringing said tray (7) to a halt for a first time opposite a first sensor means (15) for detecting the presence of a lens, said first sensor means (15) being appropriate for detecting the number of lens discs carried on said tray (7); introducing said tray (7) carrying at least one lens disc, into a coating chamber (4) provided with a coating material diffusor system (11); bringing said tray (7) to a halt for at least a second time, and each time leaving one of said lens discs carried on said tray (7) opposite said diffusor system (11); spraying said coating material over the lens disc opposite said diffusor system (11); introducing said tray (7) carrying at least one lens disc into a drying section (3) that has a ventilation system (18); and subjecting said tray (7) to said ventilation system (18).

2. The process according to claim 1, wherein said tray (7) carries one single lens disc.

3. The process according to claim 1, wherein said tray (7) carries two lens discs corresponding to a same spectacle frame.

4. The process according to claim 1, wherein at least one of said halts does not affect said conveyor belt (9).

5. The process according to claim 1, wherein during spraying, said tray (7) is moving.

6. A process according to claim 1, wherein during spraying, said tray (7) is stationary.

7. The process according to claim 1, wherein said ventilation system (18) is a forced ventilation system.

8. The process according to claim 1, wherein after said step washable paint is applied to said lens discs, where said washable paint is a first color for the lens disc intended to occupy the right-hand position in a spectacle frame and a second color, different from the first one, for the lens disc intended to occupy the left-hand position in said spectacle frame.

9. The process according to claim 1, wherein said protective coating is a water soluble, adhesive lacquer.

10. An apparatus for applying a protective coating to a lens disc, said coating being applied to one face of said lens disc intended for attachment to a blocking adaptor, said apparatus comprising: trays (7) for carrying at least one of said lens discs; means for horizontally transporting said trays (7); at least one coating chamber (4), provided with a coating material diffusor system (11) and a gas extraction means (13); a first sensor means (15) for detecting the presence of lens discs on said tray (7); at least one second sensor means (29) for detecting the presence of a tray (7) in said coating chamber (4); at least a second stopping means (27) for bringing to a halt the trays (7) detected inside said coating chamber (4); and a drying section (3) suitable for receiving the lens discs from the said coating chamber (4); said drying section (3) having a forced ventilation system (18).

11. The apparatus according to claim 10, comprising a section (5) of complementary operations for marking the said lens discs.

12. The apparatus according to claim 11, wherein said section (5) of complementary operations has at least one air brush.

13. The apparatus according to claim 10, wherein said conveyor belt (9) is formed by two parallel half belts, separated by a distance less than the width of said trays (7).

14. The apparatus according to claim 10, wherein said sensor means (29) is of the inductive sensor type.

15. The apparatus according to claim 10, wherein said diffusor system (11) comprises at least one air brush.

16. The apparatus according to claim 10, wherein said first sensor means (15) is based on ultrasound emissions.

17. The apparatus according to claim 10, wherein said first sensor means (15) is based on laser ray emissions.

18. The apparatus according to claim 10, wherein before said first sensor means (15) there is a first stopping means (23) for said tray.

* * * * *